US010796676B2

(12) United States Patent
Schille

(10) Patent No.: US 10,796,676 B2
(45) Date of Patent: Oct. 6, 2020

(54) PROGRAMMABLE ELECTRONIC HARMONICA HAVING BIFURCATED AIR CHANNELS

(71) Applicant: Ron L. Schille, Oro Valley, AZ (US)

(72) Inventor: Ron L. Schille, Oro Valley, AZ (US)

(73) Assignees: Lee Oskar Levitin, Everett, WA (US); Ron Lewis Schille, Tucson, AZ (US)

( * ) Notice: Subject to any disclaimer, the term of this patent is extended or adjusted under 35 U.S.C. 154(b) by 0 days.

(21) Appl. No.: 16/195,372

(22) Filed: Nov. 19, 2018

(65) Prior Publication Data

US 2019/0266982 A1 Aug. 29, 2019

Related U.S. Application Data

(63) Continuation of application No. 15/963,492, filed on Apr. 26, 2018, now Pat. No. 10,468,002.
(Continued)

(51) Int. Cl.
*G10H 1/00* (2006.01)
*G10H 1/32* (2006.01)
(Continued)

(52) U.S. Cl.
CPC ..... *G10H 1/0066* (2013.01); *G10D 7/14* (2020.02); *G10H 1/0008* (2013.01); *G10H 1/32* (2013.01);
(Continued)

(58) Field of Classification Search
CPC ..... G10H 1/0066; G10H 1/0008; G10H 1/32; G10H 1/386; G10H 3/146
(Continued)

(56) References Cited

U.S. PATENT DOCUMENTS 2,565,100 A * 8/1951 Tate ..... G10D 7/123 84/377
2,772,593 A * 12/1956 Zielinski ..... G10D 7/123 84/723
(Continued)

FOREIGN PATENT DOCUMENTS

WO 2018200886 A1 11/2018

*Primary Examiner* — David S Warren
(74) *Attorney, Agent, or Firm* — Burdick Patents, P.A.; Sean D. Burdick

(57) ABSTRACT

A wind instrument such as a harmonica has a mouthpiece with one or more air channels, an electric power source, and a means for generating an electrical output signal from strain gages exposed to airflow in the channels. First and second strain gages having variable flow-induced resistance are bonded to a flexible substrate and suspended within an air channel, which includes a divider shelf for directing a first airflow to the first strain gage and a second airflow to the second strain gage. Complimentary strain gages are mounted to an opposite side of the substrate for inverse flexure to enable temperature correction for the first and second strain gages. When a user forces air through a channel in a direction biased to one side of the divider shelf a difference signal is generated by the first and second strain gages and detected by comparing their outputs. The difference signal can be used to adjust a variable control signal in applications such as volume control, dimming lights, or bending notes generated by the harmonica.

11 Claims, 17 Drawing Sheets

Related U.S. Application Data

(60) Provisional application No. 62/490,520, filed on Apr. 26, 2017.

(51) Int. Cl.
*G10H 3/14* (2006.01)
*G10H 1/38* (2006.01)
*G10D 7/14* (2020.01)

(52) U.S. Cl.
CPC ..... *G10H 1/386* (2013.01); *G10H 3/146* (2013.01); *G10H 2220/361* (2013.01); *G10H 2230/211* (2013.01)

(58) Field of Classification Search
USPC ..... 84/734, 377
See application file for complete search history.

(56) References Cited

U.S. PATENT DOCUMENTS 3,322,875 A * 5/1967 Roll ..... G10H 3/16 84/733
3,516,320 A * 6/1970 Boulevard ..... G10H 1/0558 84/672
4,385,541 A * 5/1983 Muller ..... G10H 1/32 84/377
4,566,363 A * 1/1986 Arai ..... G10H 1/32 84/711
4,619,175 A * 10/1986 Matsuzaki ..... G10H 1/0555 84/377
4,984,499 A * 1/1991 Schille ..... G10D 7/123 84/377
5,038,662 A * 8/1991 Ho ..... G09B 15/04 84/453
15,038,662 8/1991 Ho
5,245,130 A * 9/1993 Wheaton ..... G10H 1/0066 84/377
5,603,065 A * 2/1997 Baneth ..... A61F 4/00 340/4.14
6,326,532 B1 * 12/2001 Antaki ..... G10D 7/123 84/377
6,462,261 B1 * 10/2002 Smith ..... G10D 7/123 84/377
6,990,435 B2 * 1/2006 Kaneko ..... G01L 1/205 340/665
7,723,605 B2 * 5/2010 Gremo ..... G10H 1/344 84/615
2008/0072746 A1 * 3/2008 Shibata ..... G10H 1/0008 84/671
2015/0027294 A1 * 1/2015 Johnson ..... G10D 9/02 84/383 R
2015/0206521 A1 * 7/2015 Sexton ..... G10H 3/146 84/609
2017/0055854 A1 * 3/2017 Choucair ..... A61B 5/0205
2017/0109127 A1 * 4/2017 Osborn ..... G10H 1/0058
2018/0025712 A1 * 1/2018 Aiwasian ..... G10H 3/16 84/734
2018/0136059 A1 * 5/2018 Fulleringer ..... G01L 3/1457
2018/0330702 A1 * 11/2018 Schille ..... G10H 1/0066

* cited by examiner

| DYNAMICS | |
|---|---|
| TERM | EFFECT |
| Piano | Soft |
| Ppianissimo | Very soft |
| Messo piano | Slightly soft |
| Forte | Loud |
| Fortissimo | Very loud |
| Messo forte | Slightly loud |
| Forepiano | Loud than soft |
| Sforzando | Sudden accent |
| Crescendo | Gradually louder |
| Diminuendo | Gradually softer |

FIG. 11

| Voice | Chord Name | Chord Inversions |
|---|---|---|
| 1 3 5 | Major | |
| 1 ♭ 3 5 | Minor | |
| 1 ♭ 3 ♭ 5 | Diminished | Root |
| 1 3 # 5 | Augmented | |
| 1 3 5 7 | Major 7th | |
| 1 3 5 ♭ 7 | Dominant 7th | First |
| 1 ♭ 3 5 6 | Minor 6th | |
| 1 ♭ 3 5 7 | Minor/Major 7th | |
| 1 ♭ 3 5 ♭ 7 | Minor 7th | Second |
| 1 ♭ 3 ♭ 5 ♭ 7 | Minor 7th b5 | |
| 1 ♭ 3 ♭ 5 ♭ ♭ 7 <6> | Diminished 7th | |
| 1 3 # 5 7 | Major 7th +5 | Third |
| 1 3 # 5 ♭ 7 | Dominant 7th +5 | |

FIG. 16

| MODE | MAJOR | | MINOR | | AUGMENTED | | DIMINISHED | | MELODY | | PROGRAM | |
|---|---|---|---|---|---|---|---|---|---|---|---|---|
| KEY | C | Db | D | Eb | E | F | F# | G | Ab | A | Bb | B |
| CELL | 1 | 2 | 3 | 4 | 5 | 6 | 7 | 8 | 9 | 10 | 11 | 12 |
| BLOW | C | E | G | C | C | E | G | C | C | E | G | C |
| DRAW | D | F | G | B | D | F | G | B | D | F | G | B |

FIG. 17

| MODE | MAJOR | | MINOR | | AUGMENTED | | DIMINISHED | | MELODY | | PROGRAM | |
|---|---|---|---|---|---|---|---|---|---|---|---|---|
| KEY | C | Db | D | Eb | E | F | F# | G | Ab | A | Bb | B |
| CELL | 1 | 2 | 3 | 4 | 5 | 6 | 7 | 8 | 9 | 10 | 11 | 12 |
| BLOW | F | Ab | C | F | F | Ab | C | F | F | Ab | C | F |
| DRAW | G | Bb | Db | Eb | G | Bb | Db | Eb | G | Bb | Db | Eb |

FIG. 18

| 3 Below | 2 Below | 1 Below | Middle C | 1 Above | 2 Above | 3 Above |
|---|---|---|---|---|---|---|

FIG. 19

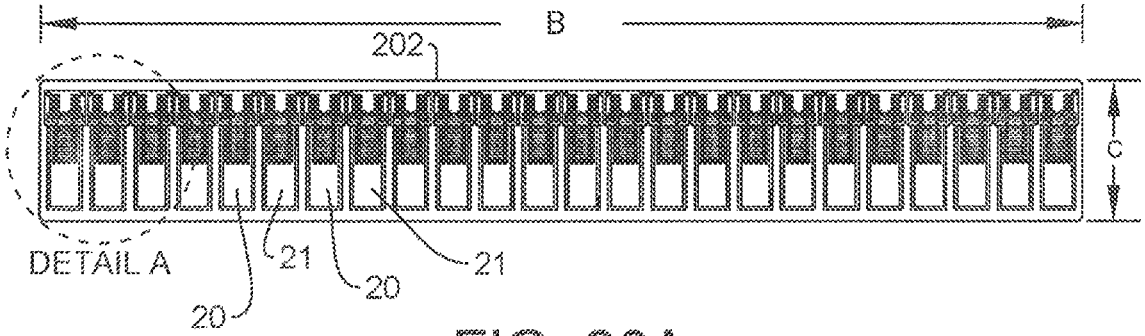
FIG. 20A
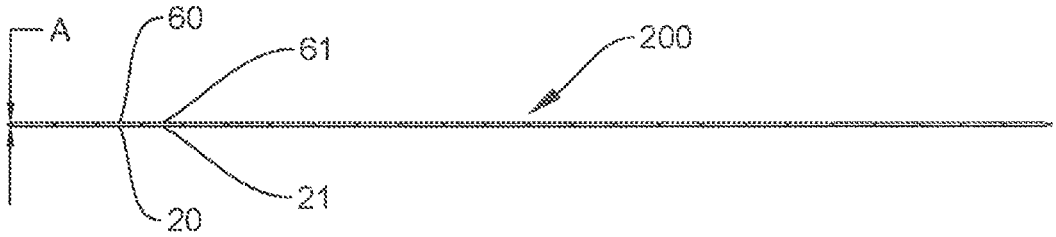
FIG. 20B
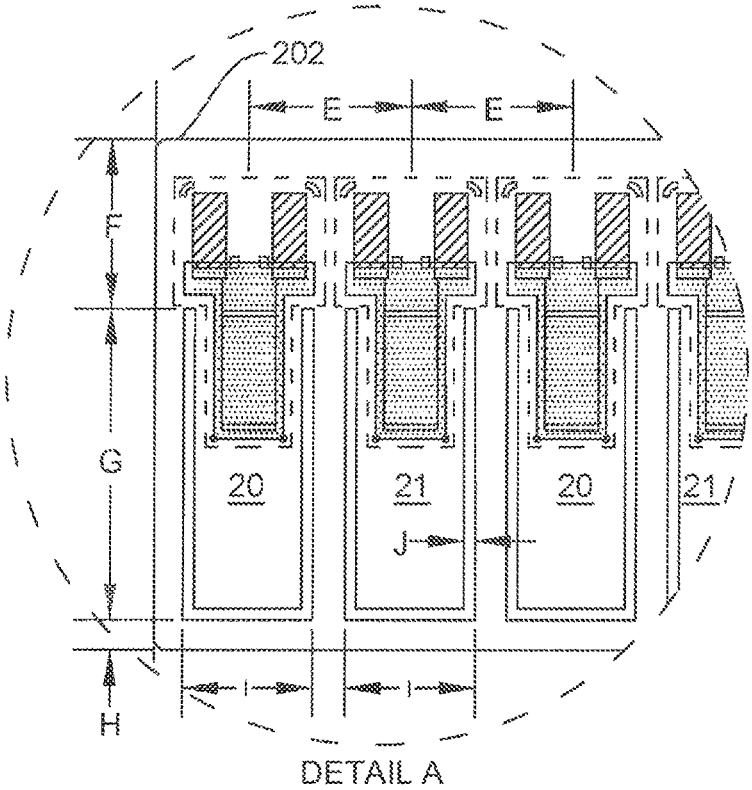
FIG. 20C
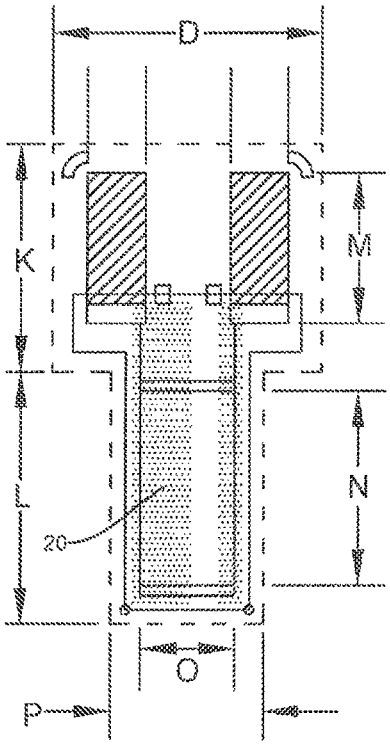
FIG. 20D
FIG. 20

PROGRAMMABLE ELECTRONIC HARMONICA HAVING BIFURCATED AIR CHANNELS

RELATED APPLICATIONS

This application claims priority to U.S. Provisional Application 62/490,520 which was filed on Apr. 26, 2017 and which is fully incorporated herein by reference as though set forth in full.

BACKGROUND OF THE INVENTION

Field of the Invention

The present invention relates generally to electronic harmonicas, more specifically to a programmable electronic harmonica compatible with the MIDI protocol, and also to a mouthpiece having bifurcated air channels that allow a person to adjust a variable control setting by mouth.

Description of Related Art

An objective of the present invention is to design a reedless harmonica for compatibility with the Musical Instrument Digital Interface (MIDI) protocol, and to design it in such a way that the resulting instrument accurately simulates the bending of musical notes in response to the same note-bending techniques employed by a musician playing a conventional harmonica. As used herein, note-bending means the sharpening or flattening of a musical note throughout a frequency range between and including tones that correspond to adjacent musical half-steps or to a larger span of steps.

U.S. Pat. No. 4,984,499 granted to the applicant of the present invention represents, generally, the state of the relevant art in 1991, and that patent is incorporated herein by reference in its entirely. Generally, the electronic harmonic disclosed in the '499 patent deploys a strain gage in each air channel in lieu of a reed, with each channel corresponding to a different predetermined musical note. The electrical resistance of each strain gage changes in response to the flow rate of air that is directed into the air channel from the mouth of a musician to cause flexure of the strain gage. By means of electrical circuitry, the change in resistance is exploited to convert the air signal to a voltage, the level of which represents the amplitude or loudness of the resulting note. The voltage signals can be further processed, for example, by analog-to-digital conversion and other filtration and amplification techniques, to provide an input signal that is compatible with the MIDI protocol.

While the '499 patent describes a working embodiment of an electronic harmonica, there remain two notable problems to overcome. First, the strain gages are sensitive to temperature variations introduced into the air channel by warm air from the musician's lungs. As a result of airflow warming the strain gage, the strain gage tends to remain slightly flexed after removal of the airflow, and slowly returns to its unflexed state as it cools to ambient temperature. The slight flexure of the strain gage causes a residual voltage signal to remain after the airflow has ceased, which causes an unwanted suspension (or sustain) of the musical note corresponding to the affected air channel. Second, because the strain gage responds to airflow only, the air channels of the harmonica can only transduce the volume of any particular note, and cannot sense whether the musician is attempting to bend the note to vary the tone. Since 1991, there have been no improvements in electronic harmonica design that have overcome the foregoing difficulties.

While solving the foregoing problems for the harmonica player, the inventor realized that his invention has uses beyond the field of music, with application in the field of ergonomics. In particular, the invention can be exploited to provide paraplegics and others with a means for manipulating by mouth variable control settings such as volume controls and dimmer switches, in the same way that a harmonica player bends notes using his or her embouchure.

SUMMARY OF THE INVENTION

The present invention addresses the foregoing problems by providing an electronic harmonica having bifurcated air channels and up to four strain gages per channel. Each air channel corresponds to a particular musical note, and the plurality of air channels collectively corresponds to an array of musical notes as would typically be found on a conventional acoustic harmonica. Detection circuitry for each air channel can be programmed to generate any desired musical note. The strain gages transduce airflow blown or drawn through an air channel into an electrical resistance signal analogous to the flow rate. Strain gages bonded on opposing sides of a substrate suspended (e.g. as a cantilever) within the air channel allow for temperature correction of the resistance signal. Bifurcation of an air channel splits the airflow into two airflows, which enables generation of a difference signal between strain gage pairs, where each strain gage pair is exposed to a different one of the two airflows. The difference signal allows the detection circuitry to vary the frequency of a musical note, to simulate a harmonica player bending the note as a result of airflow alteration.

In one embodiment, an electronic harmonica according to the invention has a body with a plurality of air channels, each air channel corresponding to a different musical note, an electric power source, and a means for enabling an electrically operated sound producing device to produce said musical notes in response to output signals from strain gages exposed to airflow in the air channels. Each strain gage has a flexible resilient element and an electrical resistance that varies in response to flexure of the resilient element. The electronic harmonic further includes first and second strain gages suspended within at least one of the air channels. One or more of the air channels may further comprise an internal divider shelf configured to divide airflow entering the air channel into first and second airflows and direct the first airflow to the first strain gage and the second airflow to the second strain gage. The electronic harmonica may further comprise a means for generating a difference signal by comparing an output signal from the first strain gage to an output signal from the second strain gage. The electronic harmonica may further comprise a means for varying frequency of a musical note corresponding to the air channel as a function of the difference signal. The electronic harmonica may further comprise an amplifier configured to amplify an output signal from the second strain gage so that its amplitude is substantially equivalent to an output signal from the first strain gage, to calibrate the instrument to behave in a normal mode (i.e. no note bending) when airflow is blown through the bifurcated air chamber in a normal manner without note bending.

Another embodiment of the invention provides an electronic harmonica having a body with a plurality of air channels, each air channel corresponding to a different musical note, an electric power source, and a means for enabling an electrically operated sound producing device to produce said musical notes in response to output signals from strain gages exposed to airflow in the air chambers. Each strain gage has a flexible resilient element and an electrical resistance that varies in response to flexure of the resilient element. The electronic harmonica further includes a substrate suspended within at least one of the air channels. The substrate has a first strain gage bonded to a forward side of the substrate and a second strain gage bonded to a rearward side of the substrate for inverse flexure. The electronic harmonica further includes temperature correction circuitry configured to subtract from an output signal of the first strain gage an output signal of the second strain gage. The electronic harmonic may further include temperature correction circuitry in the form of a half Wheatstone bridge.

In another embodiment according to the invention, an electronic harmonica combines features from the foregoing embodiments. In particular, the combines features may include (1) first and second substrates suspended within at least one of the air channels, each substrate having a forward strain gage bonded to a forward side of the substrate and a rearward strain gage bonded to a rearward side of the substrate, (2) temperature correction circuitry configured to subtract from an output signal of the forward strain gage of the first substrate an output signal of the rearward strain gage of the first substrate to generate a first temperature-corrected signal, (3) temperature correction circuitry further configured to subtract from an output signal of the forward strain gage of the second substrate an output signal of the rearward strain gage of the second substrate to generate a second temperature-corrected signal, and (4) the at least one air channel having an internal divider shelf configured to divide airflow entering the at least one air channel into first and second airflows and direct the first airflow to the first substrate and the second airflow to the second substrate. The electronic harmonic may also include temperature correction circuitry in the form of a half Wheatstone bridge. The electronic harmonica may also include a means for generating a difference signal by comparing the first temperature-corrected signal to the second temperature-corrected signal. The electronic harmonica may also include a means for varying frequency of a musical note corresponding to the at least one air channel as a function of the difference signal.

In any of the foregoing embodiments, an internal divider shelf may be configured to divide the main airflow from the musician's breath into two or more airflows in any desired proportionality. For example, the internal divider shelf may divide the main airflow into two airflows. The first of the two airflows consists of about 65% of the main airflow and the second of the two airflows consists of about 35% of the main airflow. In one embodiment, the internal divider shelf has fore and aft portions and is formed as having a curved surface with a 90-degree twist fore to aft, with the fore portion extending partway across the air channel and with the aft portion extending fully across the air channel thereby bifurcating the air channel. One example of the 90-degree twist is an internal divider shelf oriented horizontally at its fore end, and curving to a vertical orientation at its aft end.

In a generalized embodiment of the invention, a mouthpiece is provided for manipulating a variable control signal by mouth. The mouthpiece includes at least one bifurcated air channel having first and second flow paths. A substrate is suspended (e.g. as a cantilever) within each flow path. Each substrate has a strain gage pair consisting of a first strain gage bonded to a front side of the substrate and a second strain gage bonded to a rear side of the substrate for inverse flexure. The strain gages transduce airflow blown or drawn through a flow path into an electrical resistance signal analogous to the flow rate. Temperature-induced compression on the first strain gage is directly proportional to temperature-induced tension on the second strain gage, enabling temperature correction of the resistance signal using a half Wheatstone bridge. Bifurcation of the air channel enables generation of a difference signal between the flow rate analog signal that is output from each strain gage pair, where each strain gage pair is exposed to a different one of the two airflows. Detection circuitry varies a control signal in proportion to the difference signal, to provide a human user with the ability to adjust the level of the control signal between minimum and maximum values by using his or her mouth to alter the division of airflow between the two flow paths.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

FIG. 11 is a graphical representation of a selection screen displayed on a user interface module that allows a user to select dynamic options for an electronic harmonica according to the invention.

FIG. 16 is a graphical representation of a display screen on a user interface module showing different chord values that can be assigned to an auxiliary button on an electronic harmonica according to the invention.

FIG. 17 is a graphical representation of a portion of a display screen on a user interface module showing the electronic harmonica in a default key of C major, along with different selections for changing the key and mode.

FIG. 18 is graphical representation of the display screen of FIG. 17 altered by user selection to change the key to F and the mode to minor.

FIG. 19 is a graphical representation of a portion of a display screen on a user interface module showing different octave values that can be assigned to an auxiliary button on an electronic harmonica according to the invention.

FIG. 20 is a group of four detail views (FIG. 20*a*, FIG. 20*b*, FIG. 20*c* and FIG. 20*d*) of a 48-sensor strain gage plate for use within a programmable electronic harmonica according to the invention.

DETAILED DESCRIPTION OF THE INVENTION

A programmable electronic harmonica according to the present invention (also referred to herein as the "Schille" harmonica or the "instrument") is a musical instrument that uses electronics to emulate the response of a conventional harmonica to the blowing and vibrato action of a player. In addition, the Schille harmonica provides the player with the capability to couple the instrument to a MIDI system to enable many additional features for sound production. With these added features, an harmonica according to the invention can be programmed to emulate any other musical instrument, and to produce a very wide variety of chords. Rather than creating sound through the vibration of mechanical reeds, the instrument produces modulated electronic signals which are processed by standard MIDI-compatible tone synthesizers to generate a virtually unlimited repertoire of musical voices and other sounds. Breath resistance is adjustable to simulate the feel of conventional harmonicas tuned to various keys, and a hand vibrato or tremolo effect can be produced in the traditional manner. Bending of notes, and blow and draw dynamics are additional features made possible by the instrument. Advantageous include: (1) relatively simple fabrication and assembly, (2) hand vibrato or tremolo, (3) hermetically sealed mechanism, (4) capability to play single note cords and octaves, (5) no mechanical contacts in sensor, (6) instantly tunable to all 12 keys, (7) standard MIDI interface, (8) an octave switch that allows a 7 octave range, (9) no air leaks from natural to sharps or flats, and (10) wireless coupling via FM radio or Bluetooth® transmission.

Figure 1:
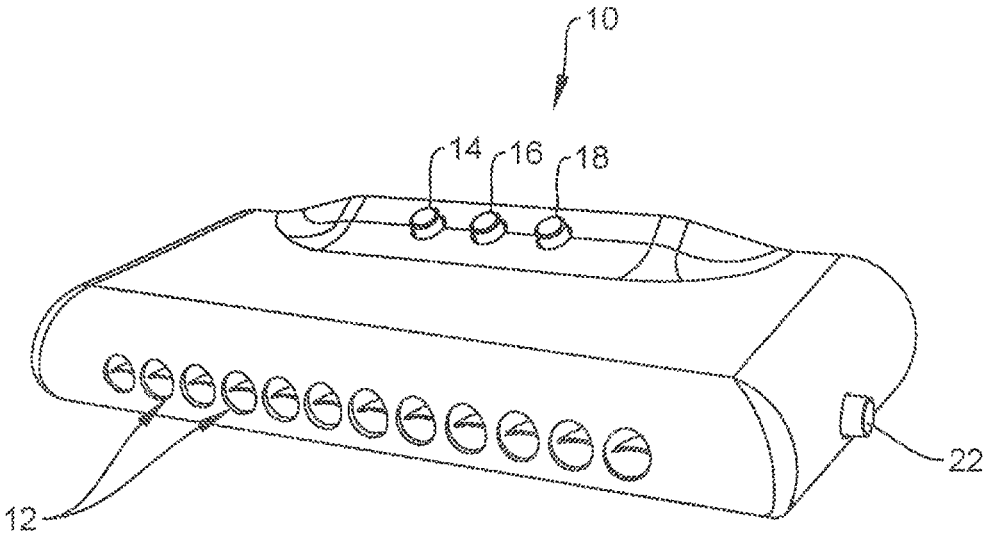
FIG. 1 is frontal perspective view of one embodiment according to the invention of a programmable electronic harmonica having bifurcated air channels.

FIG. 1 shows a frontal perspective view of one embodiment according to the invention of a programmable electronic harmonica 10 having bifurcated air channels 12. The Schille harmonica 10 can be made slightly smaller than the size of a conventional twelve-hole acoustic chromatic harmonica. The outer casing shown in this figure can be made of any rigid material such as metal or hard plastic, and is preferable formed from an injection molding process. In one embodiment, the body of the Schille harmonica provides twelve air channels 12, each of which through digital programming, explained in further detail below, can correspond to any desired musical note, such that an airflow signal detected in any channel 12 will cause the corresponding note to play. In a preferred embodiment, there are four strain gages (20, 21, 60, 61) per air channel, for a total of forty-eight strain gages that are bonded to both sides of a strain gage plate 200 (a.k.a reed plate or substrate—see FIG. 20). Three auxiliary ("aux") pushbuttons 14, 16, and 18 are mounted through the top surface of the harmonica 10. A chromatic pushbutton 22 is mounted on the right side of the harmonica, as shown. The aux buttons 14, 16, 18 and the chromatic button 22 allow the player to switch on and off various programmable features of the harmonica.

Figure 2:
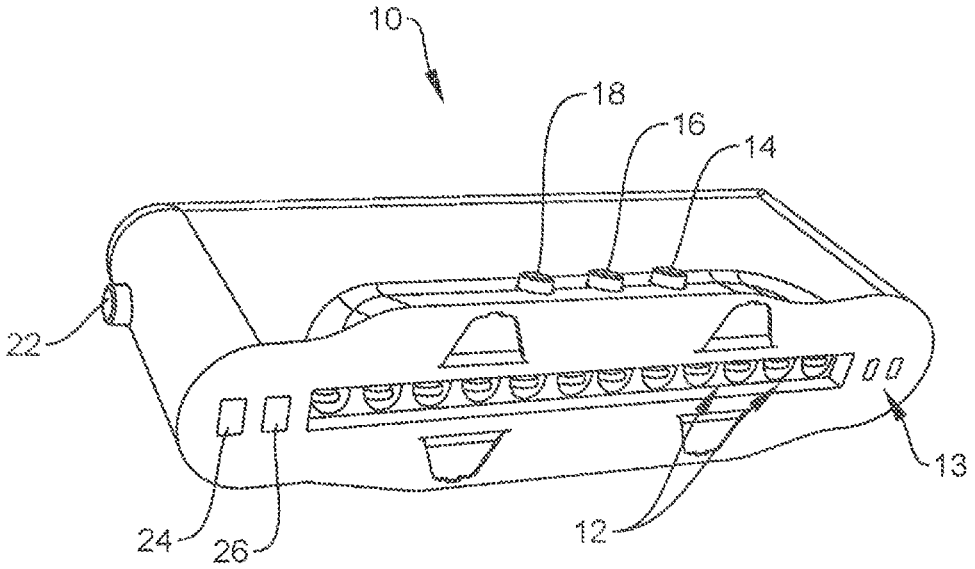
FIG. 2 is a rear perspective view of the programmable electronic harmonica of FIG. 1.

FIG. 2 is a rear perspective view of the programmable electronic harmonica 10. The bifurcated air channels 12 run all the way through the harmonica. An input jack 13 provides both a communications port and a battery charging port, and may be, for example, a single USB receptacle. An infrared emitter 24 and an infrared detector 26 are mounted on the rear side of the harmonica 10. These infrared devices allow the player to simulate hand vibrato, e.g., by the player moving his or her right hand toward and away from the infrared devices, using the same technique that the player would employ on a conventional acoustic harmonica. The infrared emitter 24 is configured to generate an infrared beam that can be reflected off the player's moving hand back toward the infrared detector 26. According to the Doppler effect, detection circuitry coupled to the infrared detector 26 senses the velocity of the player's hand. Using lookup tables or other programming techniques, the sensed velocity is mapped to a desired tremolo or pitch bend value.

Figure 3:
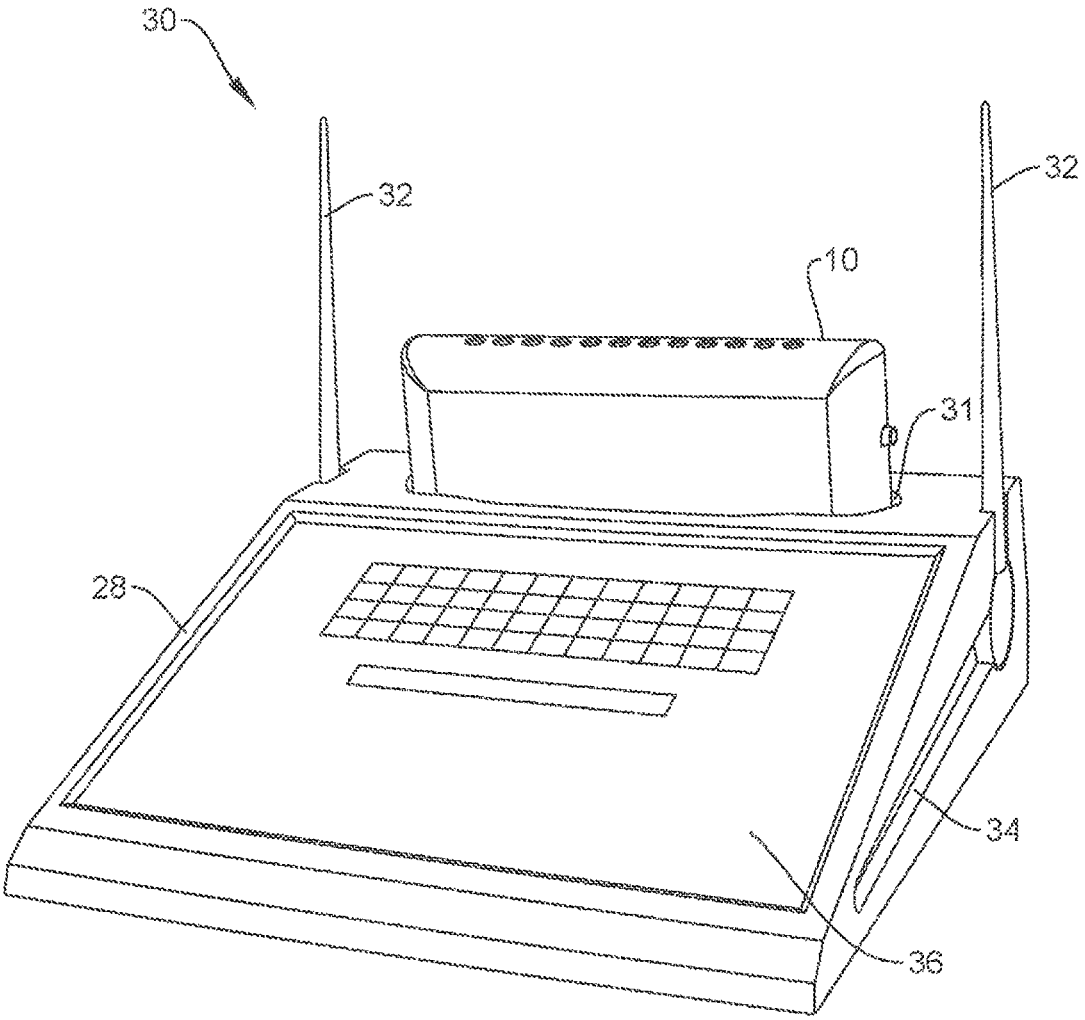
FIG. 3 is a perspective view of one embodiment of a system according to the invention showing the programmable electronic harmonica of FIG. 1 plugged into a user interface module.

FIG. 3 is a perspective view of one embodiment of a system 30 according to the invention showing the programmable electronic harmonica 10 and a user interface module 28. The user interface module 28 includes an outer casing that may be made from the same material used to manufacture the outer casing of the harmonica 10. The interface module also includes a harmonica cradle 31, a graphical user interface (GUI) 36, antenna holders 34, and internal electronics. The harmonica 10 is shown plugged into the cradle 31. In this configuration, the harmonica 10 is electrically coupled to battery charging terminals inside the interface module 28, and also to an internal signal port that allows microprocessors inside the harmonica 10 and interface module 28 to electronically communicate. Both the charging function and communications function may be provided, e.g., by a USB connector.

When the harmonica 10 is plugged into and communicating with the user interface module 28, a user by means of the GUI 36 can program the harmonica 10 to provide many customized musical features, which are described in greater detail below in connection with FIGS. 10-19. When the harmonica 10 is not plugged into the interface module 28, for example, when a musician is playing the instrument freely, the harmonica 10 runs on battery power and can transmit musical signals wirelessly (e.g. via FM or Bluetooth®) that are received by the antennae 32 that are coupled to the user interface module's electronics. The user interface module 28 translates the harmonica's wireless signals into MIDI protocol for output to a MIDI-compatible audio system. In one embodiment, the antennae can be rotated to a deployed position as shown in the figure, or they may be stowed in the antenna holders 34 that are formed on the sides of the interface module outer casing.

In one embodiment, the battery charger may be mounted within the chassis of the user interface module 28 and be configured for charging a 3.3 V NiCad flat battery pack 45 located on the bottom cover 46 of the harmonica 10. Battery packs having other voltage ratings, such as 5 VDC, are also possible. The power circuitry for the interface module 28 also includes the capability to provide the MIDI signal level output to be used by a MIDI-compatible device 58 such as a synthesizer, or by some other downstream amplifier 59.

Figure 4:
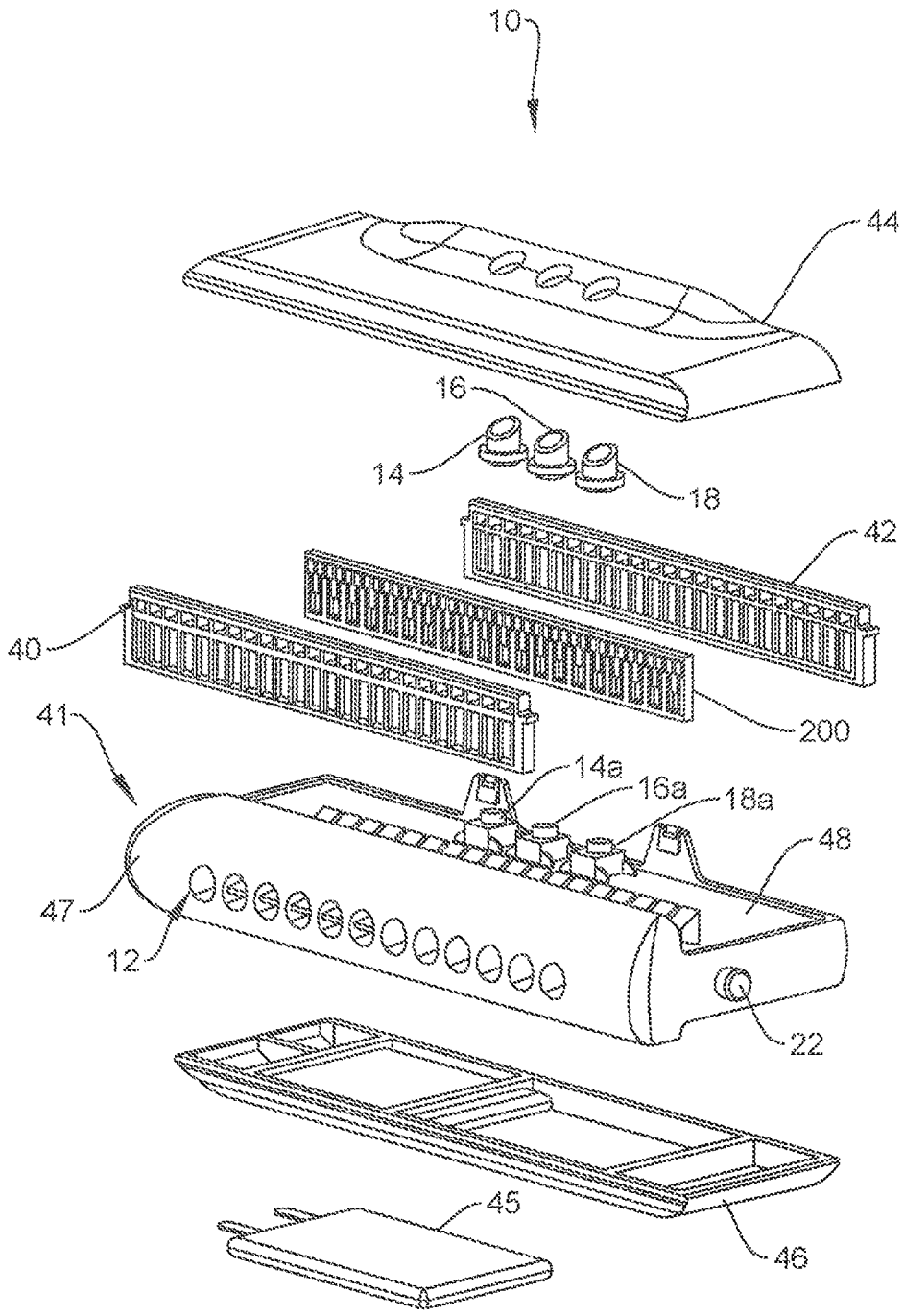
FIG. 4 is an exploded perspective view of the programmable electronic harmonica of FIG. 1.

FIG. 4 is an exploded perspective view of the programmable electronic harmonica 10. This view illustrates the main structural components of the instrument, which may all, with the exception of the strain gages, be made from molded plastic parts and assembled using conventional fastening techniques. The body 41 provides a curved mouthpiece 47 on the front face of the instrument. The mouthpiece 47 defines the twelve bifurcated air channels 12 through which the player blows and draws air to make music. To transduce the airflow into analogous electrical signals, the air is directed toward four strain gages 20 that are disposed within each of the twelve channels. In this example there are a total of forty-eight strain gages mounted inside the instrument. In a preferred embodiment, the forty-eight strain gages (20, 21, 60, 61) are bonded to both sides of the strain gage plate 200. The strain gage plate 200 may be mounted approximately midway between the front and rear faces of the harmonica 10, between a front plate housing 40 and a rear plate housing 42. One or more circuit boards 48 may be mounted within the instrument 10 to house the internal electronics and provide electrical traces for interconnections. Micro switches 14*a*, 16*a*, and 18*a*, actuated respectively by aux buttons 14, 16, and 18 may be electrically connected to the circuit board 48. Top plate 44 and bottom plate 46 may be bonded to the body 41 to hermetically seal the instrument.

Figure 5:
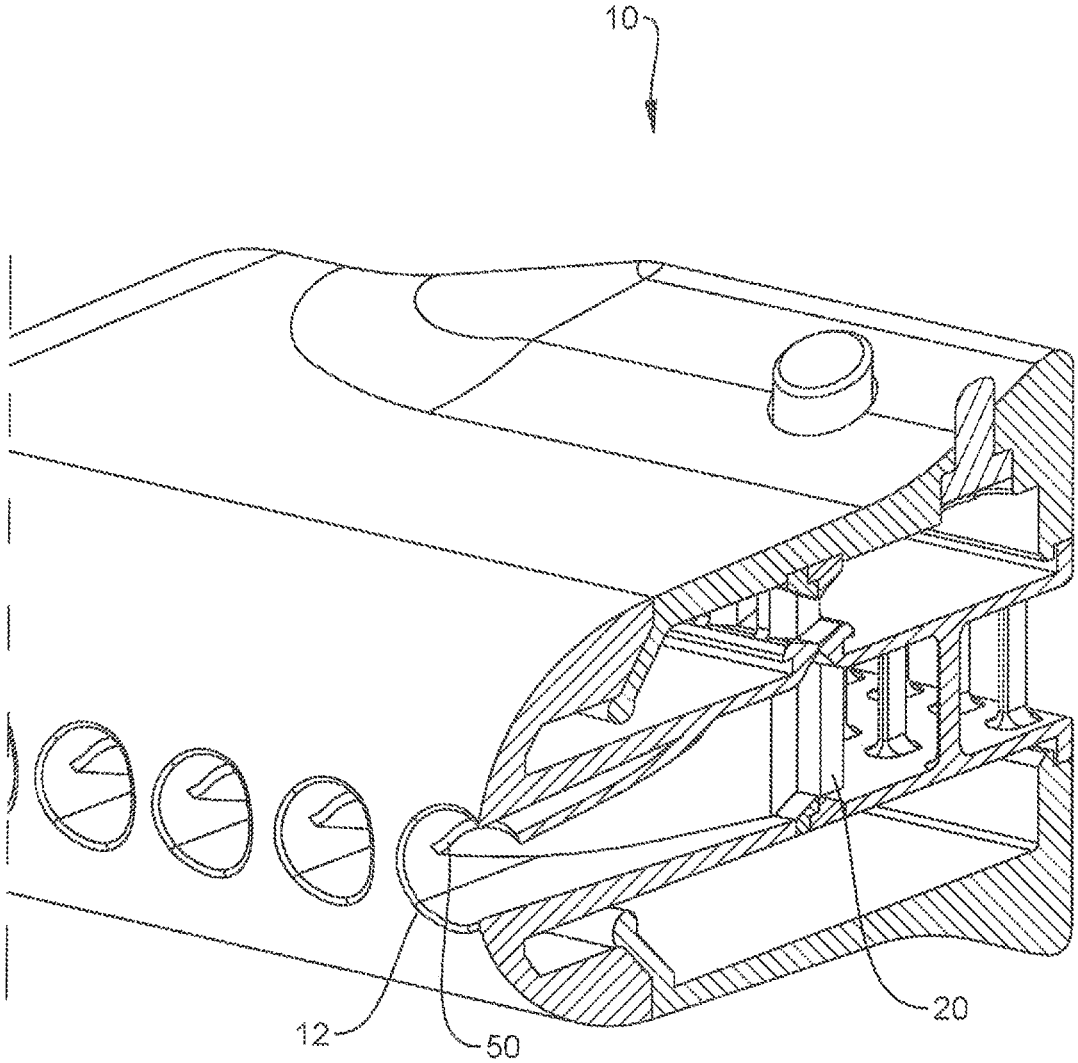
FIG. 5 is a magnified frontal perspective cutaway view of the programmable electronic harmonica of FIG. 1, showing a longitudinal cross section of a bifurcated air channel.

FIG. 5 is a magnified frontal perspective cutaway view of the programmable electronic harmonica 10. This view illustrates a longitudinal cross section of a bifurcated air channel 12. The air channel 12 is bifurcated, or split into two air channels, by an internal divider shelf 50. The divider shelf 50 is configured to divide airflow entering the air channel 12 into first and second airflows and direct the first airflow to a first strain gage and the second airflow to a second strain gage. In one embodiment, the divider shelf 50 may be configured so that airflow entering the channel 12 straight-ahead (that is, with no effort by the musician to misdirect the flow to bend a note) will be approximately equally divided between the first and second airflows. However, in a preferred embodiment, the divider shelf 50 is configured to divide the airflow unevenly, for example, so that about 65% of the flow is directed downward toward the first strain gage and so that about 35% of the flow is directed upward toward the second strain gage. Other ratios of flow division are possible within the scope of the invention. As shown in this figure, divider shelf 50 is configured as an inverted pipe section (i.e. half-pipe or third-pipe) and twisted about 90 degrees fore-to-aft as it extends from the front of channel 12 to the location of the strain gage, e.g. 20. The front end of the divider shelf 50 is raised within the channel 12 to direct a majority of straight-ahead flow below and to the right.

In one embodiment, output signals from the strain gage transducer circuits vary from 0 to 5 VDC. In one example of note bending, in a single air channel the output from the first strain gage pair may be 4 VDC while the output from the second strain gage pair may be 2 VDC. The 2-volt differential would cause the harmonica output for that channel to vary the frequency of the note corresponding to that channel by a predetermined amount according to desired programming.

Figure 6:
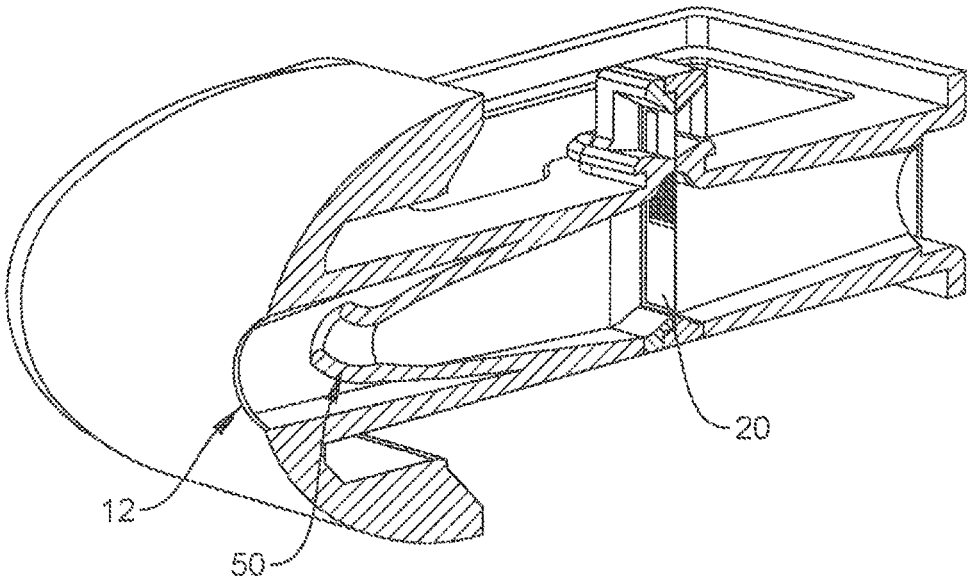
FIG. 6 is another magnified frontal perspective cutaway view of the programmable electronic harmonica of FIG. 1, showing mounting locations for strain gage pairs.

FIG. 6 shows another magnified frontal perspective cutaway view of the programmable electronic harmonica 10. This view indicates typical mounting locations for strain gage pairs. Here, the first strain gage 20 is shown at the end of the first flow path on the right end of bifurcated channel 12. The second strain gage 21 is hidden from view at the end of the second flow path behind the divider shelf 50. Together, in each channel 12, the strain gages 20 and 21 form a strain gage pair which may be referred to hereafter as a strain gage pair 20-21. Hidden from view on an opposite side of the substrate are strain gauges 60 and 61, which are mounted for inverse flexure—that is, strain gauge 60 is mounted opposite strain gauge 20 on the same substrate so that when strain gage 20 flexes in tension, generating a positive voltage, strain gage 60 compresses, generating a negative voltage, and vice versa. The same relationship applies to strain gages 21 and 61. The inverse flexure arrangement allows for correction of temperature-induced flexure by means of a half Wheatstone bridge circuit.

Figure 7:
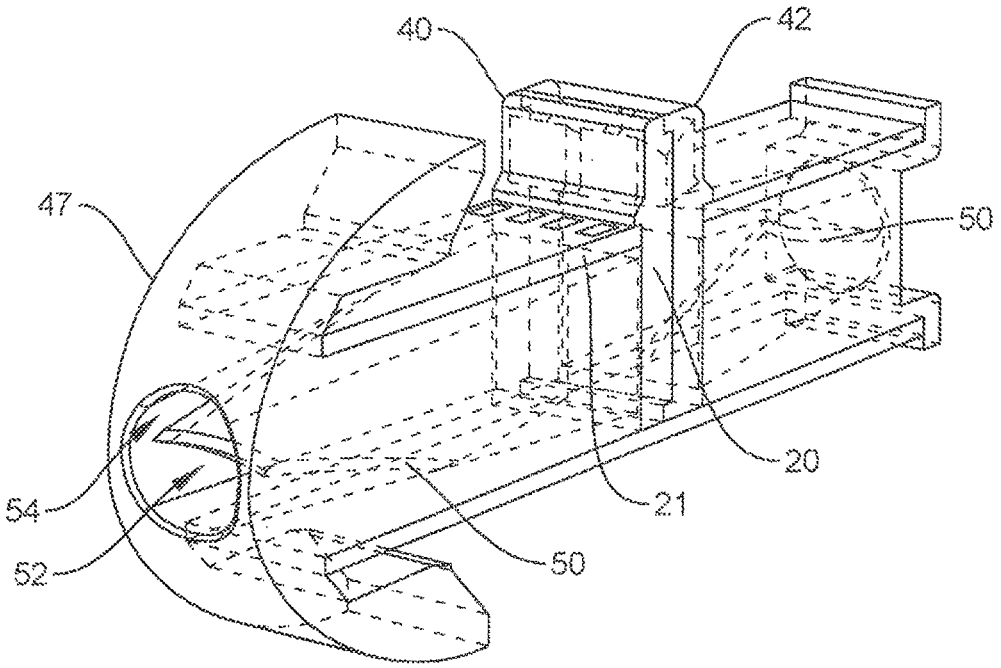
FIG. 7 is a transparent magnified frontal perspective view of a single air channel of the programmable electronic harmonica of FIG. 1.

FIG. 7 shows a transparent magnified frontal perspective view of a single air channel of the programmable electronic harmonica 10. This view illustrates the division of airflow entering channel 12 into a first airflow 52 and a second airflow 54. The first airflow 52 carries a majority of the flow and is directed by the divider plate 50 downward and to the right toward the first strain gage 20. At the same time, the second airflow 54 carries a minority of the flow and is directed by the divider plate 50 upward and to the left toward the second strain gage 21. By configuring the divider shelf to divide straight-ahead incident airflow unevenly in this manner, the channel 12 is naturally biased to impart more energy to the first strain gage 20 that to the second strain gage 21. This uneven bifurcation of the flow allows the programmer to increase the bend sensitivity of the instrument. For example, under straight-ahead airflow conditions, the lower-strength electrical signal transduced by the strain gage in the lower strength flow path can be amplified to set it equal to the higher-strength signal. Then, when a musician intends to bend a note by purposefully directing a greater amount of air into the lower strength flow path, the resulting difference signal between the two strain gages will have a greater amplitude to allow for greater sensitivity for detecting of the musician's desire to bend the note.

Figure 8:
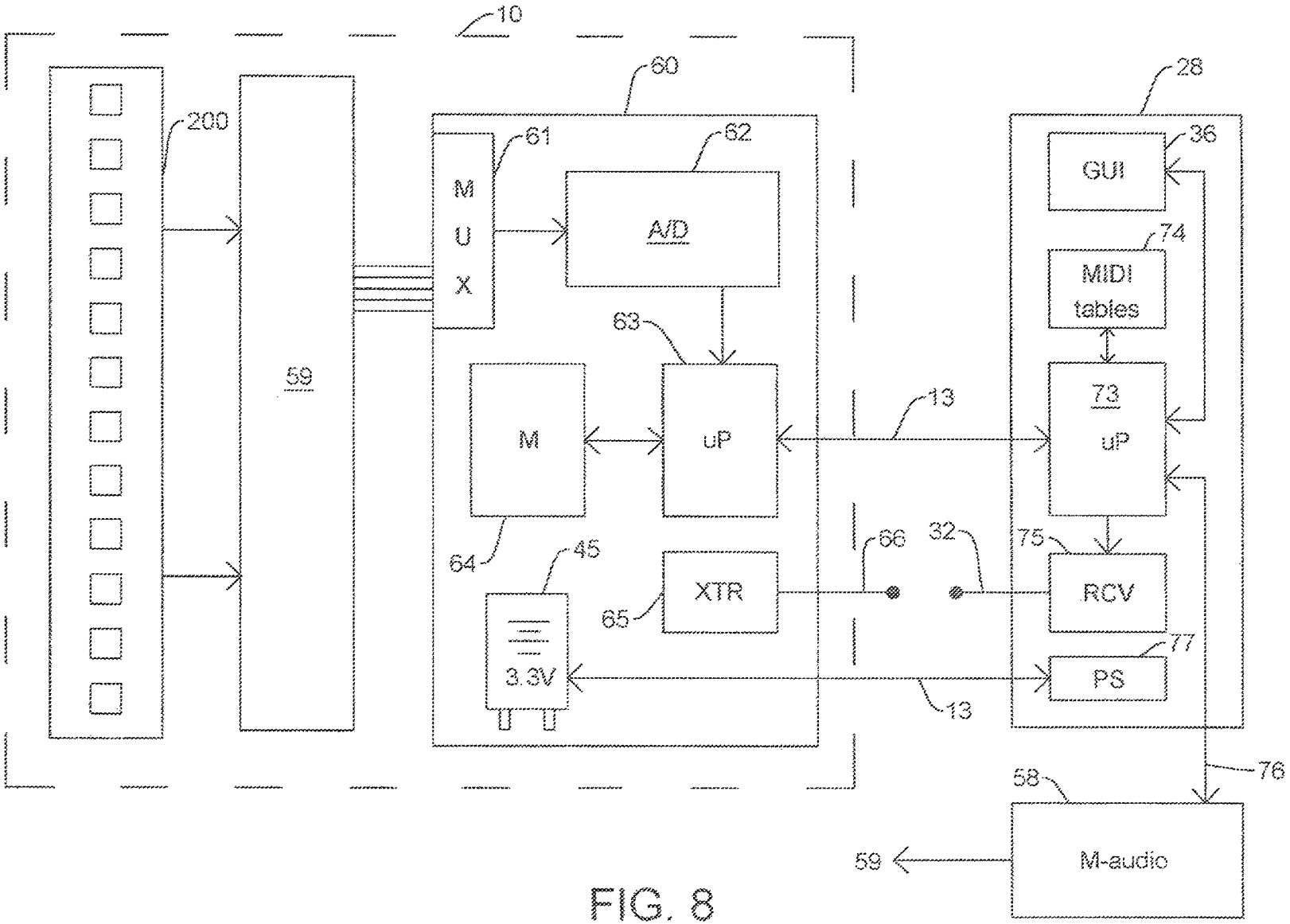
FIG. 8 is a block diagram of one embodiment of a system according to the invention for programming an electronic harmonica and generating MIDI signals using the harmonica and a user interface box.

FIG. 8 is a block diagram of one embodiment of a system according to the invention for programming an electronic harmonica and generating MIDI signals using the harmonica 10 and a user interface module 28. To aid in understanding the interaction between these two components, it may be helpful to consider that the function of harmonica 10 is analogous to that of a 24-key keyboard, as found on a MIDI piano, and that the function of the interface module 28 is analogous to the control panel with user displays typically found on the top board of the MIDI piano. In this embodiment the strain gage plate 200 includes two strain gage pairs 20-21 and 60-61 per air channel 12. In each air channel the front pair detects airflow being blown through the instrument, and the rear pair detects air flow being drawn into the instrument. The output of each strain gage pair 20-21 or 60-61 is (1) a first analog voltage typically in the 0 to 5 VDC range representing the strength of the airflow, and (2) a second analog voltage tracking the differential between the signals of the strain gage pair to represent the strength of the note bend, if any. These musical signals from all 24 channels are coupled to an upper circuit board 59 mounted within the instrument 10. From there the musical signals are sent to a lower circuit board 60 for further processing. At either circuit board, the analog musical signals may be input to an array of multiplexors 61 for better processing efficiency, to reduce the number of conduction paths on the circuit board, and so that a single A/D converter 62 may be used to convert each of the musical signals into a digital format. Output signals from the pushbutton switches 14, 16, 18, and 22 and from the infrared detector 26, may also be coupled to the lower board 60 via the upper board 59.

From the A/D converter 62, the signals are fed to a microprocessor 63. The microprocessor 63 monitors each of the digital musical signals, which the microprocessor can encode with information indicating (1) which air channel generated the signal, (2) the amplitude of the signal, and (3) the amplitude of the bend, if any. Similarly, the microprocessor 63 monitors the on/off signals from the pushbuttons 14, 16, 18, 22, and the variable signal strength from the infrared detector 26, that are used to alter the musical signals according to user-selected functions assigned to pushbutton and detector. Using firmware tables stored, for example, in memory 64, the microprocessor 63 converts each of the signals into MIDI serial format. In one example, the format in ASCII may be twelve pairs of decimal data from the strain gages, 3 0/1 switch indications from the pushbuttons, and the vibrato A/D value. The data may be separated by spaces and terminated with a \n newline. Strain gage data may be 10-bit unsigned centered around 512, with higher values for blown airflow and lower values for drawn airflow. The MIDI output signal is then transmitted wirelessly via transmitter 65 and antenna 66. Battery 45 provides all power requirements (VCC, VREF) for the electronic components of harmonica 10.

One example of a data format output by the harmonica 10 is a fixed-length, 51 byte binary packet transmitted at 230400 baud, 8 bits, no parity, consisting of: (A) 24 packets of strain gage data, 14 unsigned bits per sample divided into 2 7-bit right-justified bytes (0b0DDDDDDD), MSB to LSB, with the exception that the first channel shall have bit 7 of the first byte set to 1; (B) 1 packet of button data, 4 bits right-Justified into 1 byte (0b0000SSSS), buttons 1-4 MSB to LSB; and (C) 1 packet of hand vibrato data, 14 unsigned bits per sample divided into 2 7-bit right-justified bytes (0b0DDDDDDD), MSB to LSB. Both the strain gage and hand vibrato ADCs may return 10-bit data. The foregoing exemplary data format allows for possible future upgrades.

The user interface module 28 includes a microprocessor 73, memory 74, receiver 75, antennae 32, and GUI 36. The memory 74 stores all data and software necessary for the microprocessor 73 to operate the GUI and for translating MIDI signals received from the harmonica 10 into MIDI output 76 that can drive any MIDI compatible audio device or system 58. A power supply 77 provides all power requirements for the user interface module 28 and its components. The power supply 77 may accept 120 VAC from a conventional power outlet, and include an AC/DC converter, or it may be powered exclusively by DC batteries. In another embodiment, the power supply 77 may convert 120 VAC to desired DC voltages using an AC/DC converter, and provide a battery charger for recharging batteries installed within the user interface module 28 and also for recharging battery 45 installed in instrument 10. The USB port 13 may be used for recharging battery 45.

Figure 9A:
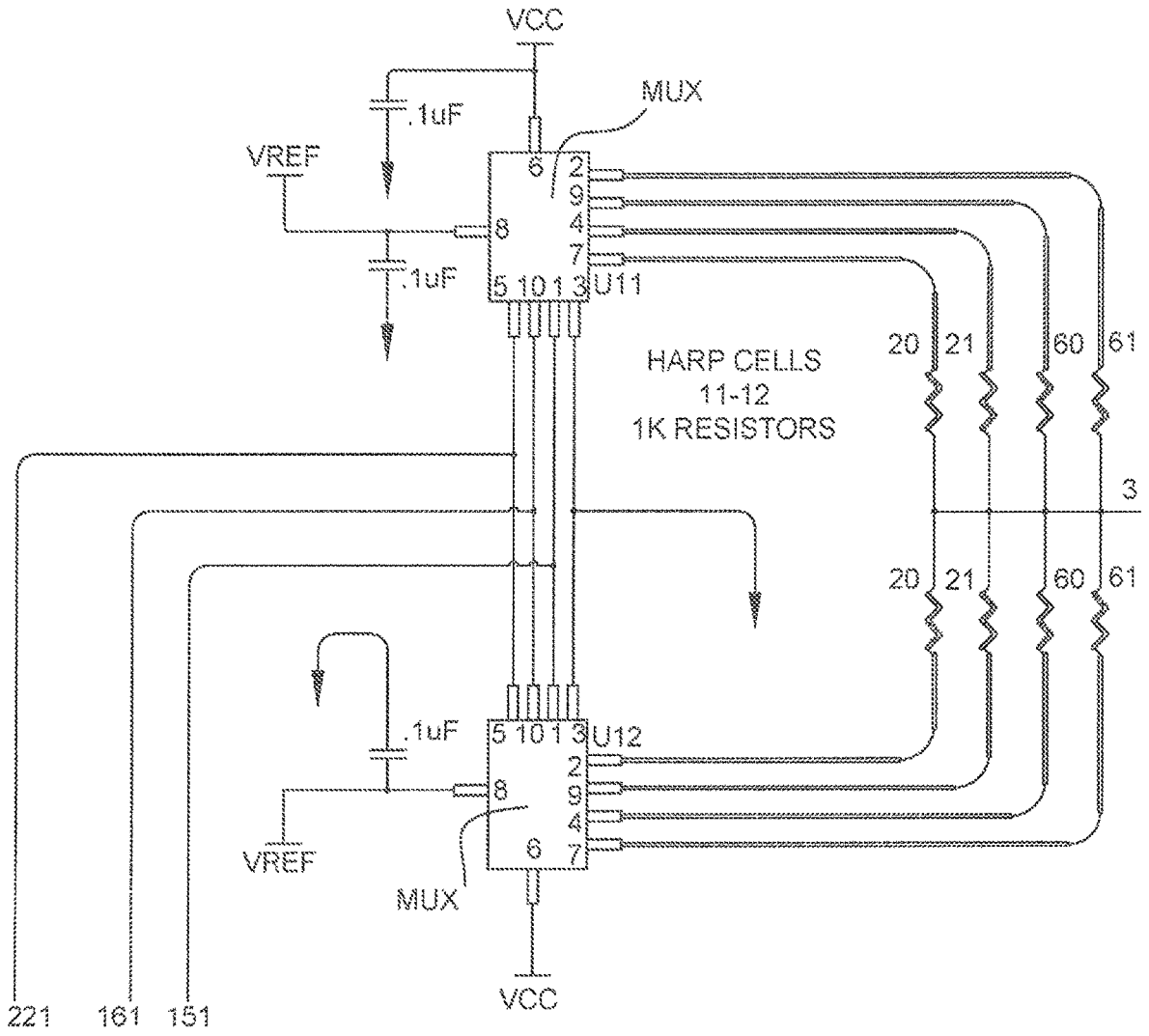
FIGS. 9*a* to 9*d* are electrical schematics according to one embodiment of the present invention for processing musical signals generated by an electronic harmonica according to the invention.

FIGS. 9*a* to 9*d* collectively show an exemplary electrical schematic according to one embodiment of the invention for processing musical signals generated by an electronic harmonica 10. FIG. 9*a* shows strain gage pairs 20-21 and 60-61 for two adjacent airflow channels, which are denoted HARP CELLS 11-12. The schematic of FIG. 9*a* is typical for all strain gage pairs in any two adjacent airflow channels in the harmonica 10. The strain gage strength and difference signals from each channel are monitored by a multiplexor U11 or U12 and output to pins 115, 116, and 122 on microprocessor 63. The multiplexed signal at node 3 is fed to the half Wheatstone bridge circuit shown in FIG. 9*c*.

Figure 9B:
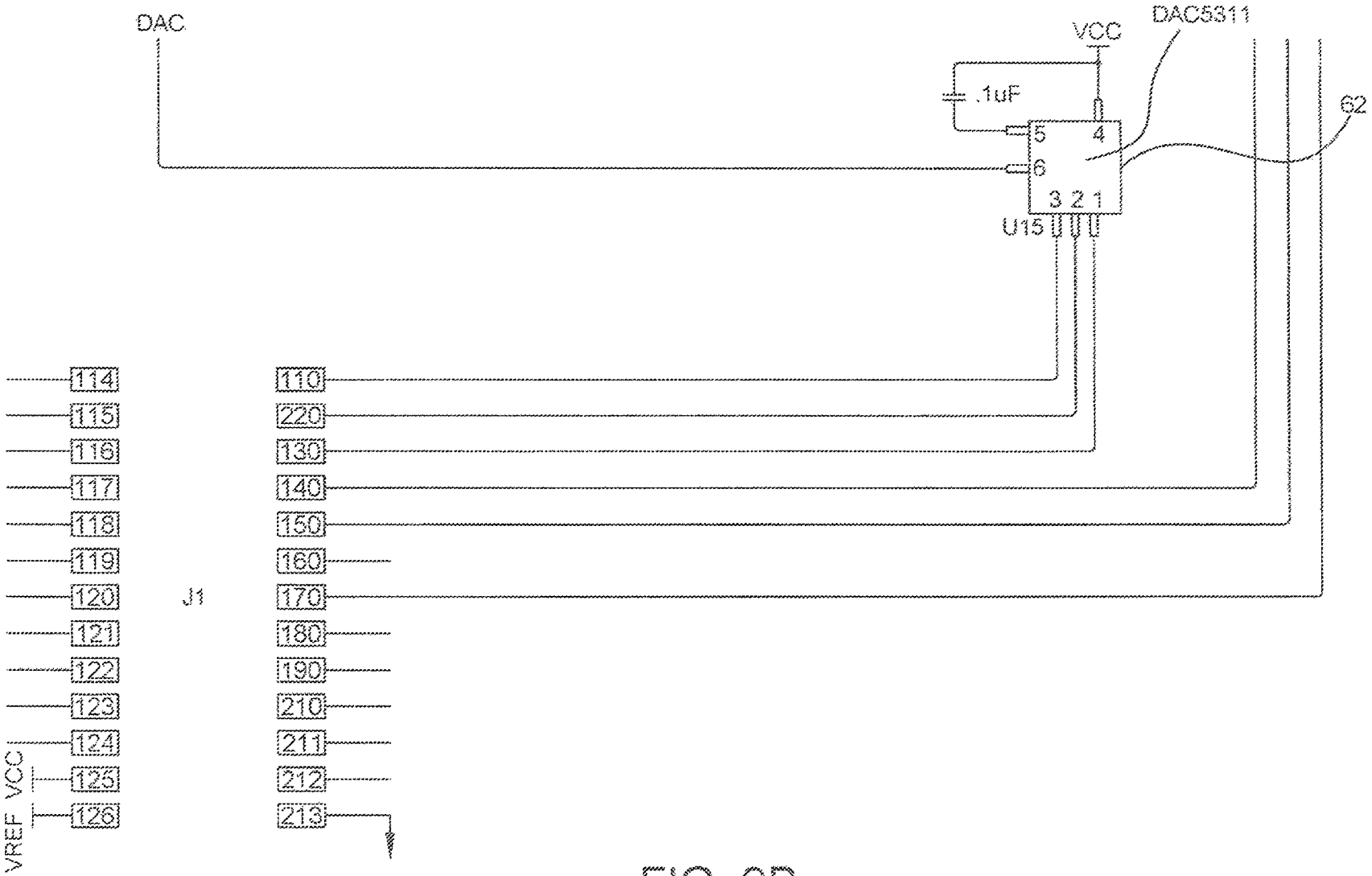
Figure 9C:
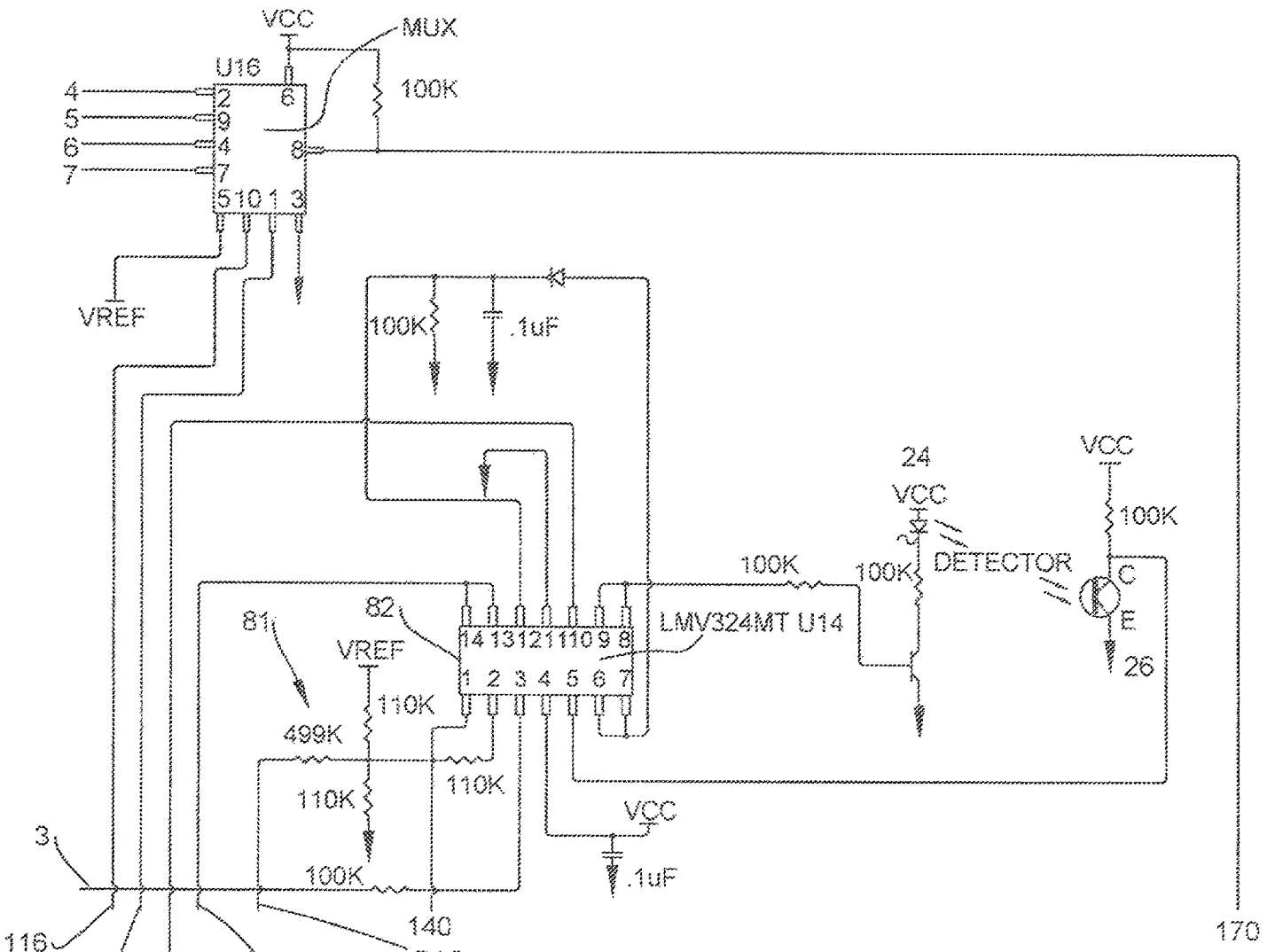
Figure 9D:
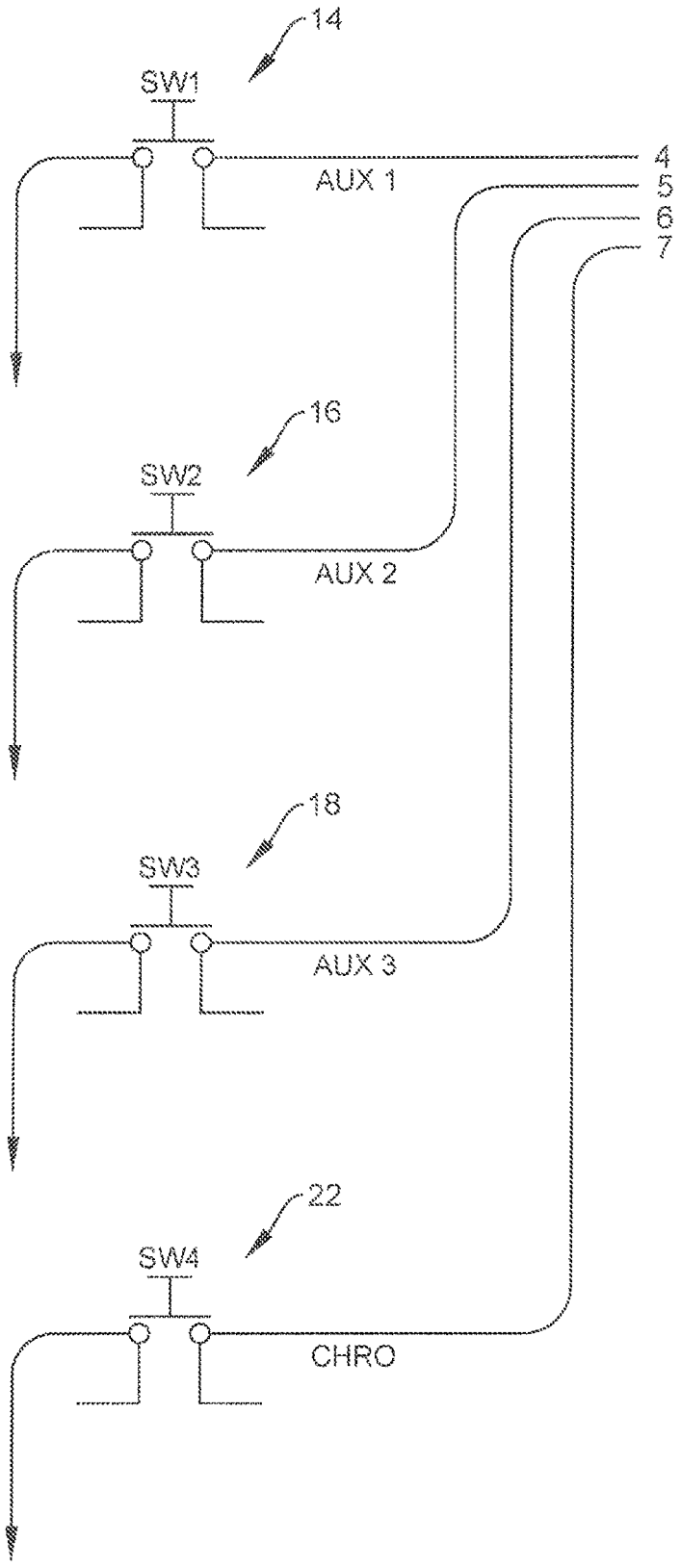

FIG. 9*b* shows connections to the microprocessor 63, and also the A/D converter 62. In one embodiment, a TI DAC5311 may be used for the A/D converter 62. Use of the multiplexors allows a single A/D device to service all strain gage signals from harmonica 10. FIG. 9*c* shows the half Wheatstone bridge circuit 81 that enables temperature correction for each complimentary pair (20-60 or 21-61) of strain gages bonded to opposing sides of the substrate for inverse flexure. The operation of such circuits is well known and will not be discussed in further detail herein. The infrared emitter 24 and infrared detector 26 are shown on the right-hand side of the figure. Signals output from the half Wheatstone bridge 81 and infrared detector 26 are amplified by the op amp 82 before being sent to the microprocessor 63. The multiplexor at the top left of the figure is configured to receive four inputs at nodes 4, 5, 6, and 7 from the pushbuttons 14, 16, 18, and 22 respectively, and pass them in serial form to the microprocessor 63. FIG. 9*d* shows the schematic connections for the pushbuttons 14, 16, 18, and 22. Throughout these figures, the nodes 3, 4, 5, 6, 114, 115, 116, 140, 150, 170 correspond to like-numbered nodes to which they are electrically connected.

Figure 10:
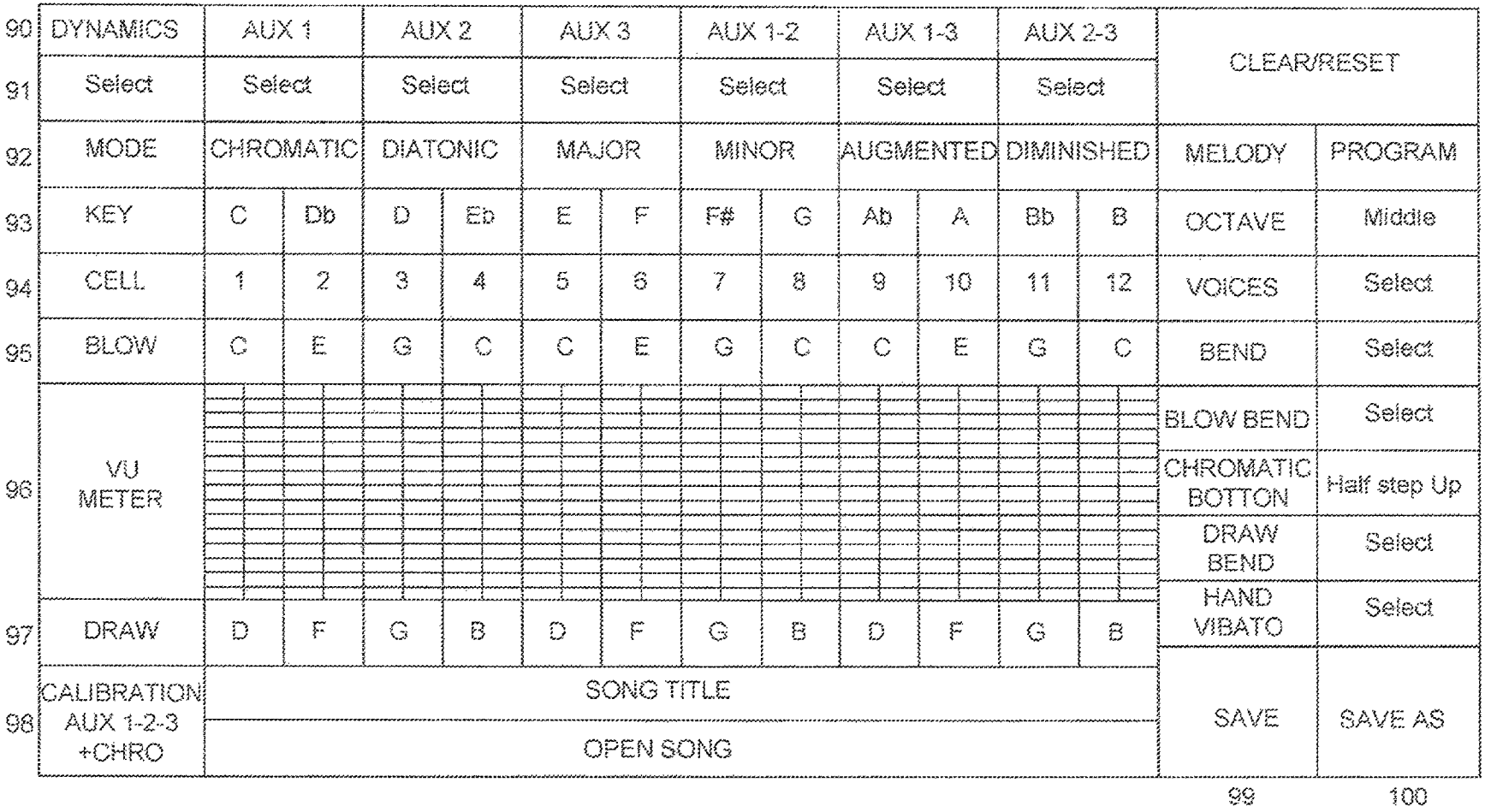
FIG. 10 is a graphical representation of a default user interface screen displayed on a user interface module according to the invention.

FIG. 10 is a graphical representation of a default configuration of the main screen of GUI 36 displayed on the user interface module 28 in one implementation of the invention. The GUI 36 is preferably a touch-screen display, and the graphical representations described herein present selectable options, or buttons, that a user can manually select to program the functionality of the harmonica 10 to perform a wide range of MIDI effects. The software for driving the GUI 36 is stored in the memory 74 and executed by the processor 73, and can be written in any conventional software code suitable for the purpose. The GUI 36 can be manipulated by a user to program the harmonica 10 when the harmonica 10 is nested within the cradle 31 and communicating with the interface module 28 via communications port 13. When a displayed button is selected, the microprocessor 73 retrieves the corresponding MIDI effect from memory 74 and assigns it to one or more MIDI events that may be received via MIDI signals from the harmonica 10. The microprocessor may also cause the same MIDI effect, or an encoded representation thereof, to be stored by microprocessor 63 in the memory 64 of the harmonica. This allows the harmonica 10 to encode the digital musical signals generated by the harmonica with the appropriate MIDI codes, so that when wireless musical signals are later received by the interface module 28, the corresponding MIDI effect can be detected along with other data indicating tone, volume, bend, and vibrato. This data enables the interface module 28 to translate the MIDI signals received from the harmonica into MIDI output signals having the desired MIDI effects.

Various buttons are shown in FIG. 10 for programming an harmonica 10 to play desired MIDI effects. Across the top row 90 there are seven buttons labeled DYNAMICS, AUX 1, AUX 2, AUX, 3, AUX 1-2, AUX 1-3, and AUX 2-3. When the DYNAMICS button is selected, a new selection window opens on the GUI 36, as shown in FIG. 11, that enables the user to select a MIDI effect for sound volume. In one embodiment, the default setting for dynamics is piano (or soft). Selecting any button in the left column under TERM will return the GUI 36 to the main screen where the Select button beneath DYNAMICS will now show the selected dynamic value, e.g. piano, forte, crescendo, etc. This value, as well as any other MIDI effect selected using the GUI 36, will cause the harmonica 10 to encode that effect on the musical signals that the player generates.

Referring again to FIG. 10, the AUX 1, AUX 2 and AUX 3 correspond to other MIDI effects that can be assigned to the action of pressing each pushbutton 12, 14, and 16, respectively. AUX 1-2 corresponds to the MIDI effect that will be assigned to the action of pressing both pushbuttons 12 and 14. AUX 1-3 corresponds to the MIDI effect that will be assigned to the action of pressing both pushbuttons 12 and 16. AUX 2-3 corresponds to the MIDI effect that will be assigned to the action of pressing both pushbuttons 14 and 16. When any of the aux buttons in row 90 are selected, the GUI 36 displays the selection window shown in FIG. 13, which shows five options: Sustain, Instrument, Chords, Key/Mode and Octave. Fewer or greater than five options are possible in different embodiments. Selecting the sustain button causes the MIDI effect of sustaining a note similar to the functionality of a sustain pedal for a keyboard. The main screen will now display "sustain" beneath the corresponding aux button. When the pushbutton (12, 14, or 16) on the harmonica 10 corresponding to that aux button is pressed, the selected MIDI effect will be encoded on the musical signal generated by the harmonica. This functionality holds true for any of the selected effects in row 91 that correspond to aux buttons or aux button combinations in row 90.

Figure 14:
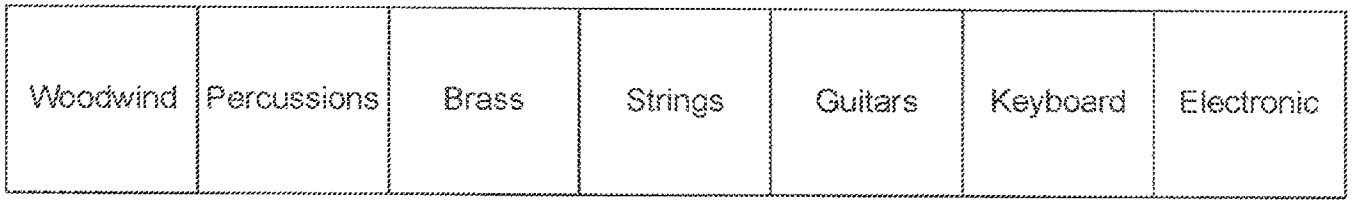
FIG. 14 is a graphical representation of a portion of a display screen on a user interface module showing selections for different musical instrument families used when assigning a particular musical instrument sound to an auxiliary button on an electronic harmonica according to the invention.
Figure 15:
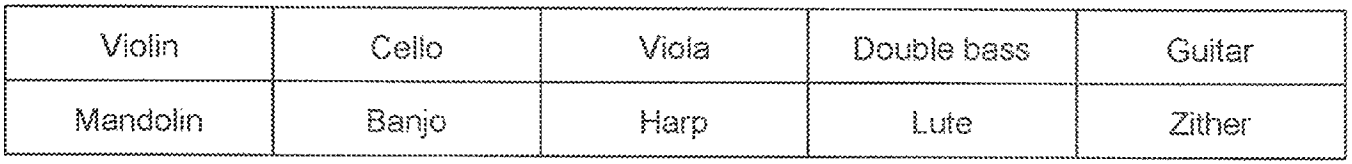
FIG. 15 is a graphical representation of a portion of a display screen on a user interface module showing selections for particular musical instrument sounds that can be assigned to an auxiliary button on an electronic harmonica according to the invention.

When the Instrument button is selected, the GUI 36 displays the selection window shown in FIG. 14, which shows additional button for selection, each representing a different musical instrument family. In this example, seven options are provided: Woodwind, Percussion, Brass, Strings, Guitars, Keyboard, and Electronic. When any of these buttons are selected, the GUI 36 displays another selection window that displays multiple buttons that allow the user to select a particular instrument from the selected family. For example, when the Woodwind button is selected from the menu in FIG. 14, the selection window shown in FIG. 15 is displayed on the GUI 36. The user may now select a particular woodwind sound from among violin, cello, viola, double bass, guitar, mandolin, banjo, harp, lute, and zither. When the selection is made, the GUI 36 returns to the main screen and displays the selected instrument in row 91 beneath the corresponding aux button or aux button combination.

Referring again to FIG. 13, when the Chords button is selected, the GUI 36 displays another selection window, such as the window shown in FIG. 16, that allows the user to select from among various different chord structures and voicings. Selection of a button beneath the center column entitled Chord Name will cause a MIDI effect of adding additional notes to the fundamental note associated with a particular air channel to form a desired chord type. Types of chords selectable here include major, minor, diminished, augmented, major 7th, dominant 7th, minor 6th, minor/major 7th, minor 7th, minor 7th flat 5, diminished 7th, major 7th+5, dominant 7thy+5, major 6th, etc. In addition, selection of a button beneath the right-hand column entitled Chord Inversions will cause a MIDI effect of changing the structure of the selected chord to place different chordal notes into the bass, e.g. root, first, second, third, etc. When these selections are made, the GUI 36 returns to the main screen and indicates the selection in row 91.

When the Key/Mode button is selected, rows 92, 93, 95 and 97 on the main screen are enabled for assigning any desired mode or key to an aux button. The buttons when selected cause corresponding MIDI effects and main screen display changes in the same manner as described above with respect to other MIDI effect selections. Selectable modes in row 92 adjust the intervals for each of the airflow channels so that the pattern of intervals matches that of a desired mode, e.g. major, minor, augmented, and diminished. In row 93, any of the musical notes may be selected to change the key, or fundamental tone of the harmonica. For example, in FIG. 17, a default setting is shown in which the key is C and the mode is major. In this setting, all of the air channels or cells indicated in row 94 will generate a note in the key of C major, whether air is blown into or drawn into the channel. In FIG. 18, however, the F button has been selected in row 93 and the minor button has been selected in row 92, which changes the key/mode of the harmonica to *F minor*. As a result, all of the air channels will now generate a note in the key of *F minor*, according to the notes displayed in rows 95 and 97 for each of the cells, whenever the corresponding aux button or combination of aux buttons is pressed.

Figure 13:
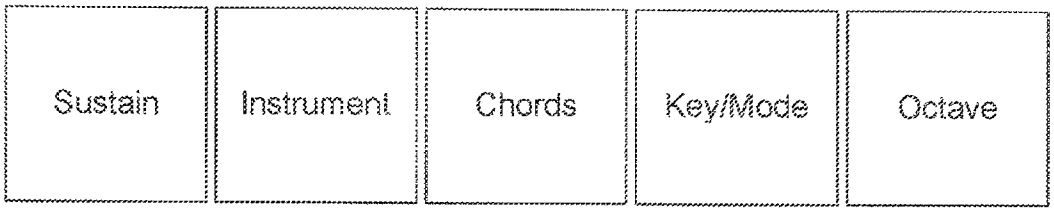
FIG. 13 is a graphical representation of a portion of a display screen on a user interface module showing selections for different musical effects that can be assigned to an auxiliary button on an electronic harmonica according to the invention.

When the Octave button is selected from the selection window if FIG. 13, the user can assign a particular octave to an aux button. Pressing the Octave button causes the GUI 36 to display a selection window such as that shown in FIG. 19. From this window, the user can assign to an aux button the MIDI effect of raising or lowering the octave tuning of the instrument by one, two, or three octaves above or below the default middle octave.

Figure 12:
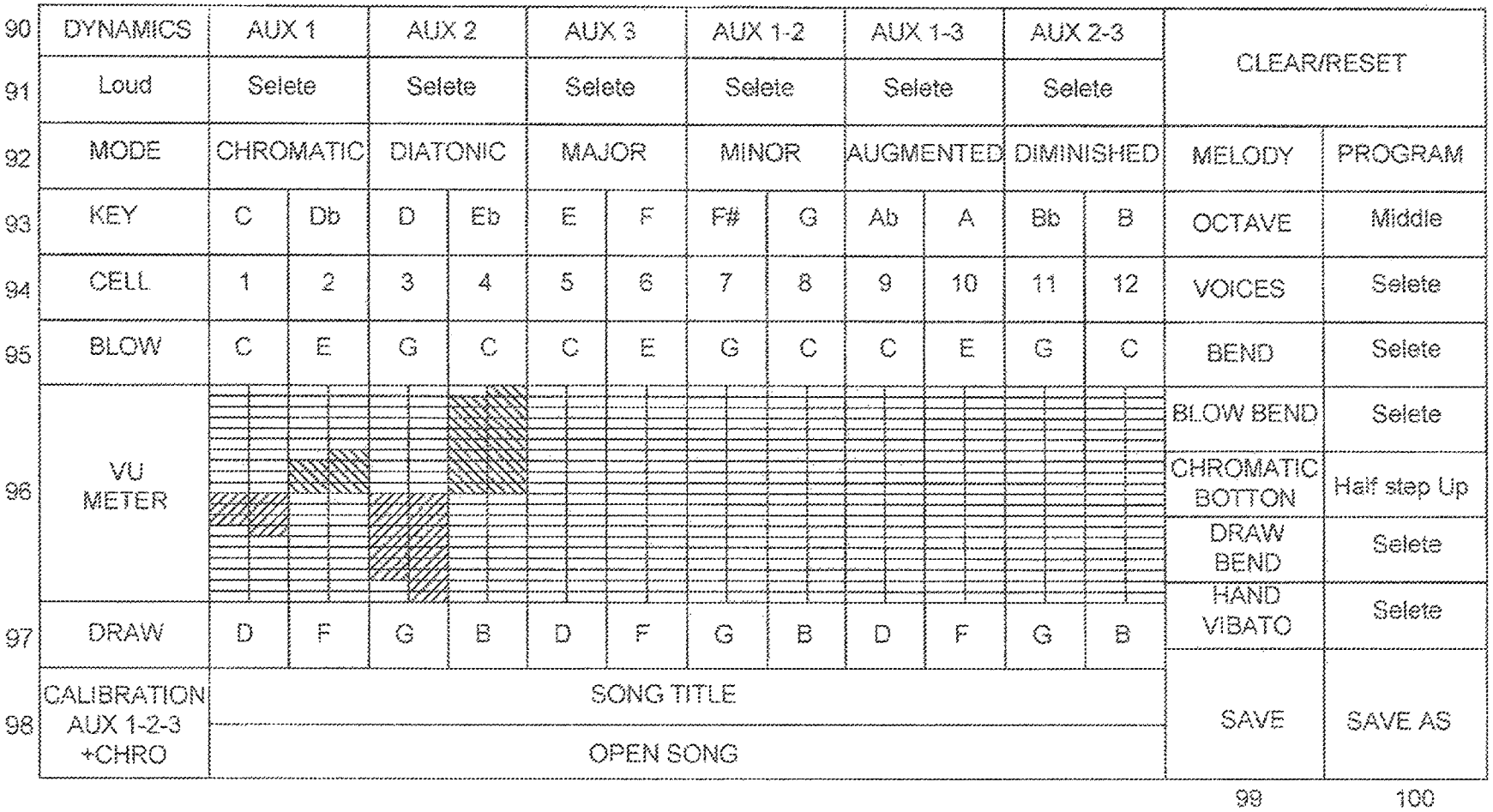
FIG. 12 is a graphical representation of a display screen on a user interface module showing voltage levels generated in four channels of an electronic harmonica according to the invention.

With reference now to FIG. 12, the main screen is shown again to illustrate additional functionality of an electronic harmonica according to the invention. In row 96, the GUI 36 can provide a simulated VU or volt meter in bar graph form, to display to the user the signal strength occurring in each airflow channel 12 when the user blows or draws air through the instrument. The upper half of the VU meter at 96 indicates the signal strength in positive VDC when air is blown through a channel 12, and the lower half of the VU meter indicates the signal strength in negative VDC when air is drawn through a channel 12. These values typically vary between 0 and +/−5 VDC. Note also that the signal strength in each cell displays two graphical values side by side, which indicate the difference signal between the two strain gages of a strain gage pair 20-21 in a single cell. The display of signal strength in this manner allows the user to calibrate various setpoints for invoking additional MIDI effects, such as those listed in column 99. For example, the BLOW BEND and DRAW BEND buttons allows the user to adjust the sensitivity or setpoint of the strength of a difference signal that is required to invoke a bending effect. For example, the user can specify in the adjacent column 100 that no bend should occur until the difference signal is at least 75%. The BEND button allows the user to select the amount of bend (or variation in tone) that occurs when the setpoint is met to effect the bend. The bend selected, as shown in column 100, can be a single half step, a whole step, or even greater intervals. The CHROMATIC button in column 99 can be selected to cause a MIDI effect corresponding to pressing button 22. For example, the effect may be to raise the tones of the airflow channels each by one half step to emulate the functionality of an acoustic chromatic harmonica. The HAND VIBRATO button allows the user to select the setpoint or sensitivity of frequency change sensed by the infrared detector that is required to invoke the MIDI effect of vibrato. A user selecting options from the adjacent button in column 100 may also specify minimum and maximum vibrato speed and interval range.

Additional functionality: Row 98 in FIGS. 10 and 12 provides additional functionality that allows a user to calibrate the harmonica, and to save, using the SAVE and SAVE AS buttons, a GUI setting by name, e.g. according to the musical requirements of particular song that corresponds to the setting. The CLEAR/RESET button at the top of columns 99 and 100 when selected may return the GUI to its default settings. In one embodiment, when a user presses all three aux buttons 12, 14, and 16 simultaneously, the processor 63 invokes functionality to re-zero all of the strain gages in the instrument, effectively resetting the instrument and canceling any residual signal drift.

FIG. 20 is a group of four detail views (FIG. 20*a*, FIG. 20*b*, FIG. 20*c*, and FIG. 20*d*) of a 48-sensor strain gage plate 200 for use within a programmable electronic harmonica according to a preferred embodiment of the invention. The frontal view shown in FIG. 20*a* shows the strain gage plate 200 consisting of 12 strain gage pairs 20-21 (or a total of 24 strain gages) arranged side-by-side on the front side of a substrate 202. The top view FIG. 20*b* shows an equal number of complimentary strain gage pairs 60-61 arranged in similar fashion on the rear side of the substrate. There are therefore 48 total strain gages bonded to the substrate 202. FIG. 20*c* shows a magnified view of DETAIL A of FIG. 20*a*. FIG. 20*d* shows a magnified view of a single strain gage 20.

Strain gage 20, 21, 60, or 61 may be a series N2A gage, and intended for use in an elastic strain field, such as the airflow chamber 12. The substrate is preferably formed from 1 mil thick full hard 304 stainless steel, to ensure excellent resiliency. As an indication of scale of the harmonica 10 in general, the following nominal dimensions for one embodiment of the strain gage plate are disclosed: A=0.001 in., B=3.6 in., C=0.47 in., D=0.14 in., E=0.15 in., F=0.16 in., G=0.29 in., H=0.28 in., I=0.12 in., J=0.01 in., K=0.19 in., L=0.13 in., M=0.08 in., N=0.10 in. O=0.05 in., and P=0.08 in.

In view of the foregoing disclosure, it should be apparent to one of skill in the relevant art that a programmable electronic harmonica enables multiple inventions. One such invention is an improvement on the concept of an electronic harmonica having a body with a plurality of air channels, each corresponding to a different musical note, an electric power source, and means for enabling an electrically operated sound producing device to produce said musical notes in response to output signals from strain gages exposed to airflow in the air chambers, wherein each strain gage having a flexible resilient element and an electrical resistance that varies in response to flexure of the resilient element. The improvement provides first and second strain gages suspended within an air channels, the air channel having an internal divider shelf configured to divide airflow entering the air channel into first and second airflows and to direct the first airflow to the first strain gage and the second airflow to the second strain gage.

The electronic harmonica is further improved by providing a means for generating a difference signal by comparing an output signal from the first strain gage to an output signal from the second strain gage. The electronic harmonica is further improved by providing a means for varying the frequency of a musical note generated from an air channel of the harmonica as a function of the difference signal detected by the strain gages suspended in the air channel. The electronica harmonica is further improved by a substrate suspended in an air channel of the harmonica, the substrate having a first strain gage bonded to a forward side of the substrate and a second strain gage bonded to a rearward side of the substrate, and temperature correction circuitry configured to subtract from an output signal of the first strain gage an output signal of the second strain gage.

The electronic harmonica is further improved by providing first and second substrates suspended within an air channel of the instrument, each substrate having a forward strain gage bonded to a forward side of the substrate and a rearward strain gage bonded to a rearward side of the substrate, temperature correction circuitry configured to subtract from an output signal of the forward strain gage of the first substrate an output signal of the rearward strain gage of the first substrate to generate a first temperature-corrected signal, wherein the temperature correction circuitry is further configured to subtract from an output signal of the forward strain gage of the second substrate an output signal of the rearward strain gage of the second substrate to generate a second temperature-corrected signal, and wherein the air channel has an internal divider shelf configured to divide airflow entering the at least one air channel into first and second airflows and direct the first airflow to the first substrate and the second airflow to the second substrate.

In a more generalized application, the technology of the present invention can be used to allow a human being to continuously vary a control signal by manipulating air flow though an air chamber by means of his or her mouth. The invention therefore provides a mouthpiece, at least one bifurcated air channel dividing airflow entering the mouthpiece into first and second flow paths, a substrate suspended within each of the flow paths, each substrate having a strain gage pair consisting of a first strain gage bonded to a front side of the substrate and a second strain gage bonded to a rear side of the substrate, temperature correction circuitry coupled to at least one of the strain gage pairs, and detection circuitry configured to transduce airflow blown or drawn through the flow paths and generate a difference signal analogous to flow rate difference between the flow paths.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An instrument for manipulating a variable control signal by embouchure, comprising:

a mouthpiece;

a bifurcated air channel dividing airflow through the mouthpiece into first and second flow paths within the bifurcated air channel;

a first substrate suspended within the first flow path and having a first means for transducing air pressure into a first electronic signal;

a second substrate suspended within the second flow path and having a second means for transducing air pressure into a second electronic signal; and detection circuitry configured to receive the first electronic signal and the second electronic signal and to generate a difference signal analogous to flow rate difference between the airflow through the first flow path and the airflow through the second flow path in response to airflow blown or airflow drawn through the bifurcated air channel.

2. The instrument of claim 1 wherein the bifurcated air channel includes an internal divider shelf that divides incident airflow equally between the first and second flow paths.

3. The instrument of claim 2 wherein the internal divider shelf is configured to divide the incident airflow approximately equally between the first and second airflows when the incident airflow is straight-ahead.

4. The instrument of claim 2 wherein the internal divider shelf is configured to divide the incident airflow unevenly between the first flow path and the second flow path when the incident airflow is straight-ahead.

5. The instrument of claim 2 wherein the internal divider shelf directs about 65% of the incident airflow to the first flow path and about 35% of the incident airflow to the second flow path.

6. The instrument of claim 2 wherein the internal divider shelf is unattached to the bifurcated air channel at the open end of the bifurcated air channel.

7. The instrument of claim 2 wherein the internal divider shelf has a curved surface with a 90-degree twist fore to aft.

8. The instrument of claim 7 wherein the fore portion of the internal divider shelf extends partway across the bifurcated air channel and the aft portion extends fully across the bifurcated air channel.

9. The instrument of claim 1 wherein the bifurcated air channel includes an internal divider shelf extending from an open end of the bifurcated air channel to the first substrate.

10. The instrument of claim 1 further comprising a means for varying frequency of a musical note as a function of the difference signal.

11. The electronic harmonica of claim 1 further comprising an amplifier configured to amplify the first electronic signal to substantial equivalence with amplitude of the second electronic signal.

* * * * *